US009068384B2

(12) United States Patent
Dorman

(10) Patent No.: US 9,068,384 B2
(45) Date of Patent: Jun. 30, 2015

(54) FOLDING CARPORT

(71) Applicant: White Aluminum Products, LLC, Leesburg, FL (US)

(72) Inventor: William Malcolm Dorman, Umatilla, FL (US)

(73) Assignee: WHITE ALUMINUM PRODUCTS, LLC, Leesburg, FL (US)

( * ) Notice: Subject to any disclaimer, the term of this patent is extended or adjusted under 35 U.S.C. 154(b) by 0 days.

(21) Appl. No.: 14/075,328

(22) Filed: Nov. 8, 2013

(65) Prior Publication Data

US 2014/0165495 A1 Jun. 19, 2014

Related U.S. Application Data

(60) Provisional application No. 61/738,208, filed on Dec. 17, 2012.

(51) Int. Cl.

| | |
|---|---|
| ***E04H 12/18*** | (2006.01) |
| ***E05D 1/06*** | (2006.01) |
| *E05D 1/04* | (2006.01) |
| *E04H 6/02* | (2006.01) |

(52) U.S. Cl.

CPC ..... *E05D 1/06* (2013.01); *Y10T 16/554* (2015.01); *E05D 1/04* (2013.01); *E04H 6/025* (2013.01)

(58) Field of Classification Search

CPC ..... E05D 1/06; E05D 1/04; Y10T 16/554; E04H 6/025

USPC ..... 52/645, 73, 64, 66, 69, 71, 72

See application file for complete search history.

(56) References Cited

U.S. PATENT DOCUMENTS

| | | | | |
|---|---|---|---|---|
| 2,896,651 | A * | 7/1959 | Hilligoss | 135/143 |
| 4,100,703 | A * | 7/1978 | Sickler | 52/16 |
| 5,058,333 | A * | 10/1991 | Schwartz | 52/73 |
| 5,109,643 | A * | 5/1992 | Speers | 52/91.3 |
| 5,170,811 | A * | 12/1992 | Kirk et al. | 135/88.11 |
| 6,167,897 | B1 * | 1/2001 | Resso et al. | 135/121 |
| 7,178,536 | B2 * | 2/2007 | Holtkamp | 135/88.13 |
| 7,213,869 | B1 * | 5/2007 | McClellan | 296/161 |
| 8,607,512 | B2 * | 12/2013 | Batut et al. | 52/173.3 |
| 2003/0101677 | A1 * | 6/2003 | Hewett | 52/655.1 |
| 2005/0060951 | A1 * | 3/2005 | Kalnay | 52/641 |
| 2008/0095573 | A1 * | 4/2008 | Hewett et al. | 403/190 |
| 2009/0126281 | A1 * | 5/2009 | Santini | 52/7 |
| 2010/0199578 | A1 * | 8/2010 | Checketts | 52/202 |
| 2012/0103391 | A1 * | 5/2012 | Tucker | 136/245 |
| 2012/0124922 | A1 * | 5/2012 | Cusson et al. | 52/173.3 |
| 2013/0098858 | A1 * | 4/2013 | Cusson et al. | 211/189 |
| 2013/0269750 | A1 * | 10/2013 | Tucker | 136/245 |

* cited by examiner

*Primary Examiner* — Mark Wendell

(74) *Attorney, Agent, or Firm* — Husch Blackwell LLP

(57) ABSTRACT

A foldable carport comprising a header having a hinge socket fastened to an inhabitable structure and, a connection beam, a tilt beam, and a roof deck spanning between the two beams, all of which comprise a roof assembly. The connection beam includes a hinge member that is received into the header socket thereby operably connecting the roof assembly to the header. The operable connection allows the roof assembly to be positioned in an erected position or a folded position. When erected, the tilt beam is supported by a plurality of posts that may bear on a concrete slab, footing, or the ground. The foldable carport may also include a carrier plate coupled to the mobile residence configured to fasten the roof assembly to the mobile residence when the carport is in the folded position.

8 Claims, 8 Drawing Sheets

FOLDING CARPORT

CROSS-REFERENCE TO RELATED APPLICATIONS

This application claims the benefit of U.S. Provisional Patent Application No. 61/738,208, filed Dec. 17, 2012, the entire disclosure of which is hereby incorporated by reference.

BACKGROUND OF THE INVENTION

1. Field of the Invention

The present invention is in the field of carports, particularly a foldable carport that can be attached to any inhabitable structure including, but not limited to mobile residences, mobile homes, recreational vehicles, travel trailers, and residential homes.

2. Description of Related Art

Carports are often constructed along side a home in lieu of a garage. Mobile residences such as mobile homes, recreational vehicles, travel trailers or any other mobile or temporary residence or office also incorporate carports in many various circumstances. Although carports are associated with many inhabitable structures, particular shortcomings become evident when erecting a carport proximate a mobile home. Mobile homes are relatively inexpensive residences and allow an affordable way to live. Mobile homes or trailers may also be used by construction project managers on the job site to function as the on-site office from which the construction of a building, road, or other project is managed. Recreational vehicles and travel trailers provide many of the same features as mobile homes, but can also be more easily taken from one site to another and used the remainder of the year.

When mobile residences are intended to be substantially stationary for a longer period of time, users, particularly in warm and sunny climates, desire a carport erected adjacent to the mobile residence to provide a covered area to park a car so that the car is stored out of the damaging effects of the sun. Further, because the sun may be very intense, keeping the car out of direct sunlight prevents the seats and interior of the car from becoming uncomfortably hot which then typically requires cooling the interior turning on the car and running an air conditioner prior to using the car. A carport may also provide an additional covered outdoor living space which can be used in virtually all weather conditions. This feature is desired for many mobile home residents because it increases the functional living space of the mobile residence, even when it is raining.

All current mobile residence carports are permanently installed at the mobile home site. Thus, when a seasonal resident closes up the mobile residence to return north for the spring, summer and/or fall, current carports remain erected and subject to all of the weather events which may occur in the owner's absence. A permanently installed carport may be damaged during the nine months of the year that the owner is not occupying the home and the owner is unable to maintain or fix the carport during this time. Further, while the owner is away from the mobile residence, the mobile residence is unoccupied and vulnerable to break-in by others who know that the mobile residence is vacant for the spring, summer, and/or fall. In addition, a permanently installed carport is also not ideal to be combined with a mobile residence because once the carport is installed, it is permanent and, therefore, if an owner wants to move the mobile residence for any reason, the carport is often abandoned or left at the old location.

There are no currently known carports that can be semi-permanently erected, but easily folded down so that the mobile residence can be moved over-the-road while the carport remains connected thereto or folded down during extended periods of vacancy. Further, there are no carports on the market which provide the carport to be hinged into a more secure position that (1) secures an entrance to the mobile home during the periods it is unoccupied, or (2) protects one or more exterior walls of the mobile home during storm events.

Thus, there is a need in the art for a carport for any inhabitable structure, but commonly for a mobile residence wherein the carport can be semi-permanently erected, but also easily folded down so that the mobile residence can be moved over-the-road while the carport remains connected thereto. Further, there is also a need in the art for a folding carport to be attached to a mobile residence with a hinged connector that can be erected on site and then can be folded using a hinged assembly into a more secure position that (1) secures an entrance to the mobile home during the periods it is unoccupied, and (2) protects one or more exterior walls of the mobile home during storm events.

SUMMARY OF THE INVENTION

The present invention is directed to a foldable carport for any inhabitable structure, including mobile residences, such as mobile homes, recreational vehicles, travel trailers or any other mobile trailer, temporary residence or office. The foldable carport can also be attached to a conventional or prefabricated home or building. The foldable carport may comprise a header configured to be fastened to the mobile residence, a roof assembly comprising a connection beam, a tilt beam and a roof deck spanning between the two. The connection beam and the tilt beam provide the structural support for a roof deck which spans between the two and the connection beam is configured to be hingedly connected to the header. Further, bracing may be integrated into the roof assembly to provide structural stability and lateral stiffness. The tilt beam of the roof assembly may be supported by one or more of posts.

One embodiment includes the header having a connection leg extending away from an exterior wall of the mobile residence. The connection leg terminates with a hinge socket that is configured to receive a hinge member of a connection beam. The hinge member is configured to be complementary and received into the socket of the header. Thus, the roof assembly is operably connected to the mobile residence by the hinge member being received into socket of the header. The operable connection allows the roof assembly to be positioned in an erected position or a folded position. When erected, the tilt beam is supported by one or more posts that may bear on an existing or new concrete slab or footing, or directly on the ground with or without an anchored tie-down. The roof deck may be conventional steel roof decking or may be decking of any other material or shape capable of spanning between the connection beam and the tilt beam.

The foldable carport may also include one or more carrier plates coupled toward the bottom of the floor structure of the mobile residence. The carrier plates are configured to fasten the roof assembly to the mobile residence when the carport is in a folded position. The carrier plates may be positioned to match the spacing of the posts so that the holes in the tilt beam used to connect the posts to the tilt beam can also be used to secure the roof assembly to the carrier plates.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
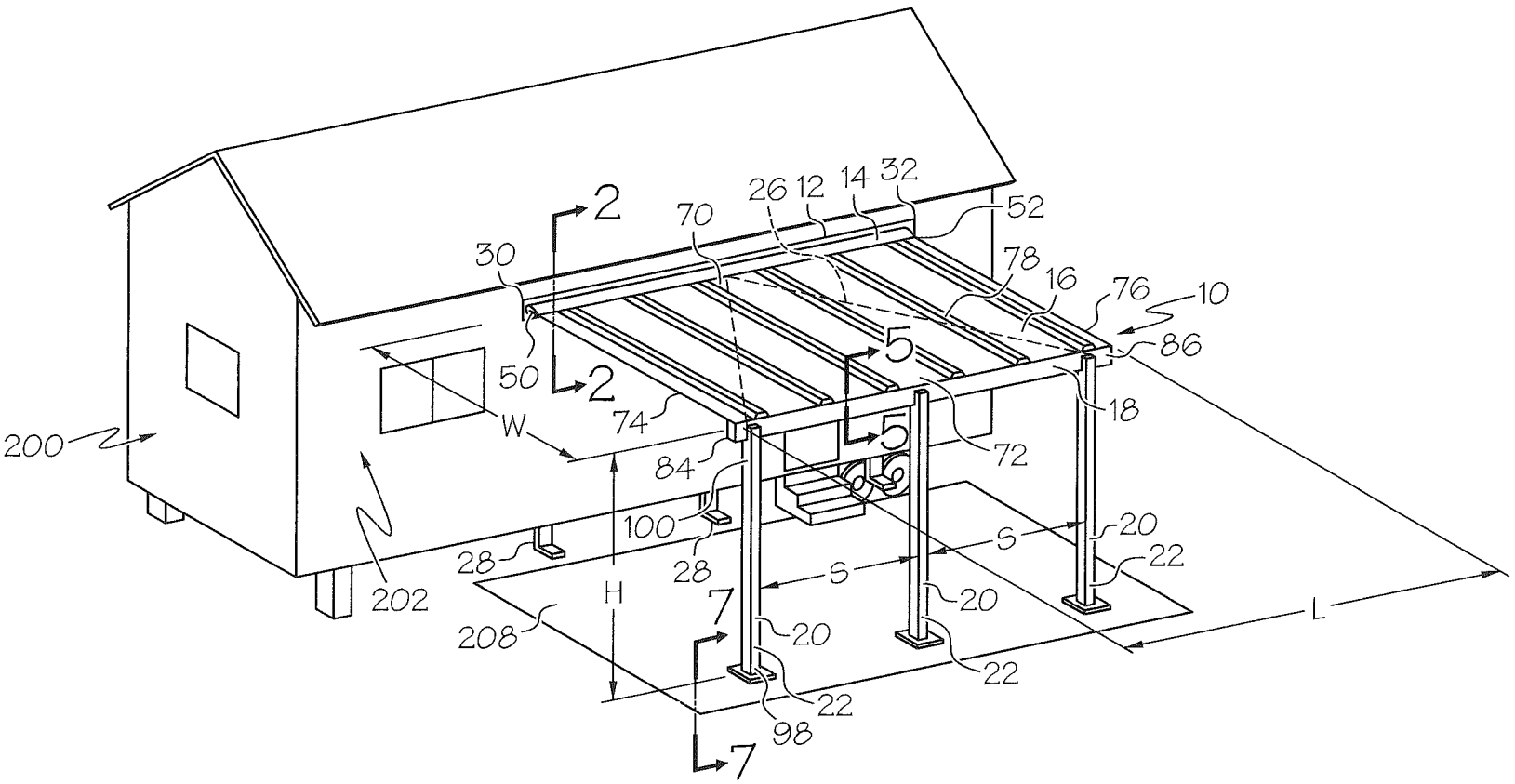
FIG. 1 is a perspective view of one embodiment of a folding carport in accordance with the teachings of the present invention.

As illustrated in FIG. 1, the present invention is directed toward a folding carport 10 that can be used in a number of circumstances, most notably, attached to a manufactured home, a mobile home, recreational vehicle ("RV"), or a travel trailer, for clarity, these items will be collectively referred to herein as a "mobile residence." In addition, a person of skill in the art will appreciate that folding carport 10 may also be attached to a conventional or prefabricated home or building. The mobile residences and other identified structures may also be referred to as an inhabitable structure. FIG. 1 illustrates one embodiment wherein folding carport 10 coupled to an existing mobile residence 200; however, the description below is applicable to any inhabitable structure. Folding carport 10 comprises a header 12 that is coupled to an exterior wall 202 of mobile residence 200. Header 12 is configured to support roof connection beam 14 in a hingedly manner A roof deck 16 comprises one or more roofing pieces that are coupled to connection beam 14 and a tilt beam 18. The roof deck 16 generally spans between connection beam 14 and tilt beam 18. Tilt beam 18 is supported by one or more posts 20 which are anchored to an existing concrete slab 208 with a post base 22.

Figure 2:
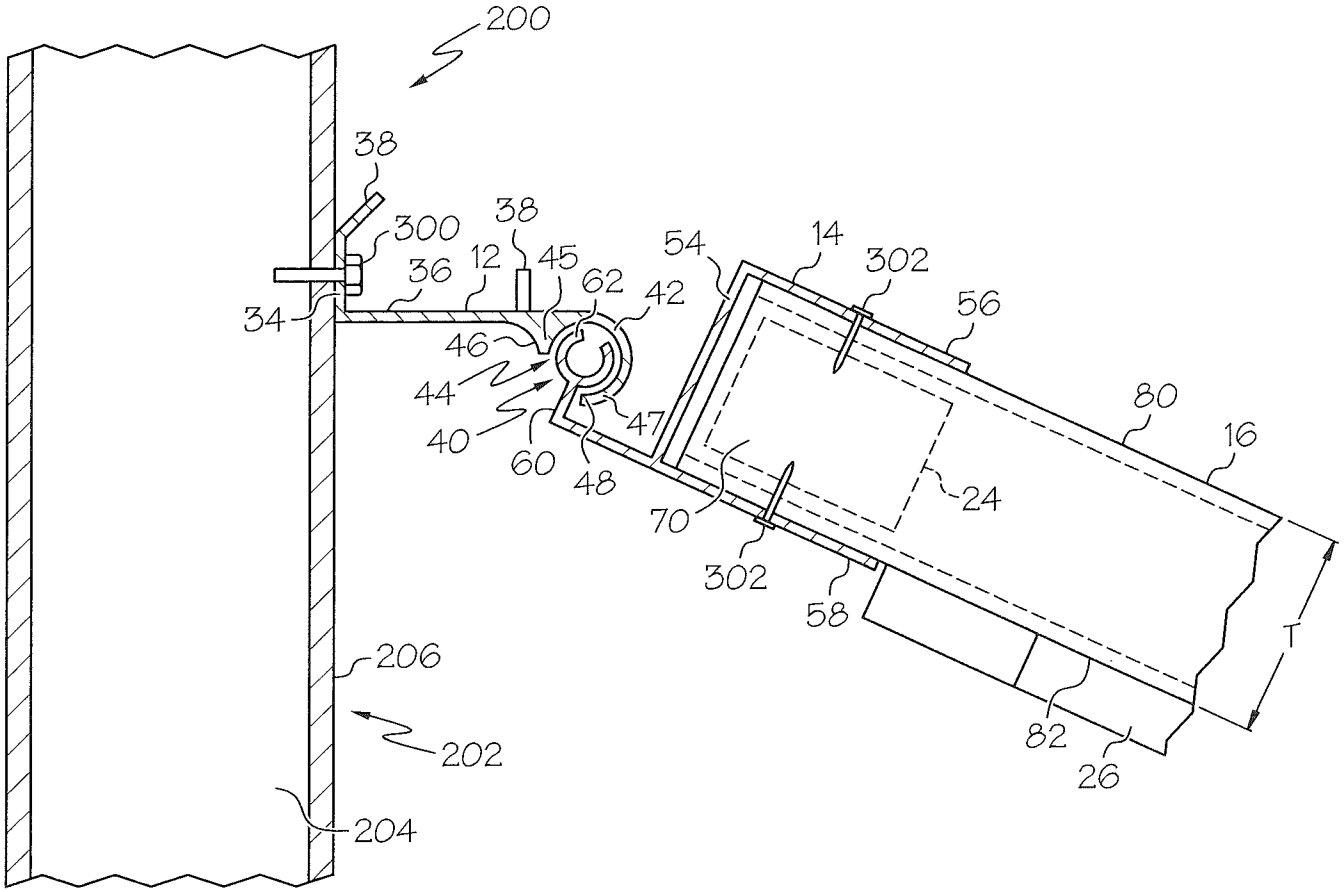
FIG. 2 is a sectional view of the embodiment of the folding carport of FIG. 1 cut along the line 2-2.

As shown in FIG. 1, header 12 spans between a first end 30 and a second end 32. FIG. 2 shows a sectional view cut through exterior wall 202 of mobile residence 200. Exterior wall 202 comprises a wall stud 204 or vertical structural member having sheathing 206 attached on one or both sides of the wall stud. Wall stud 204 may be wood, polymer, metal, composite, carbon fiber or any material now known or hereafter developed to act as a structural member. Wall stud 204 may be a solid member, a tube or pipe, a C-shape, or be any other shape now known or hereafter developed. Sheathing 206 may be wood-based sheathing, polymer sheets, sheet metal, gypsum board, cement board, carbon fiber, or any other sheathing material now known or hereafter developed.

As shown in FIG. 2, header 12 is coupled to wall stud 204 using a fastener 300 at a specified spacing as determined by a person of skill in the art. Common spacing of fasteners 300 may be every wall stud 204, every other wall stud 204, every third wall stud 204, or any other spacing now known or hereafter determined. Fastener 300 may be a lag-bolt, screw, nail, glue, a mechanical or chemical weld, or any other fastener now known or hereafter developed. As shown, header 12 is generally in an "L" shape that comprises a connection leg 34 and a header leg 36. Header 12 may further include one or more stiffeners 38 disposed on either connection leg 34 or header leg 36 to increase the bending stiffness of header 12.

Figure 4:
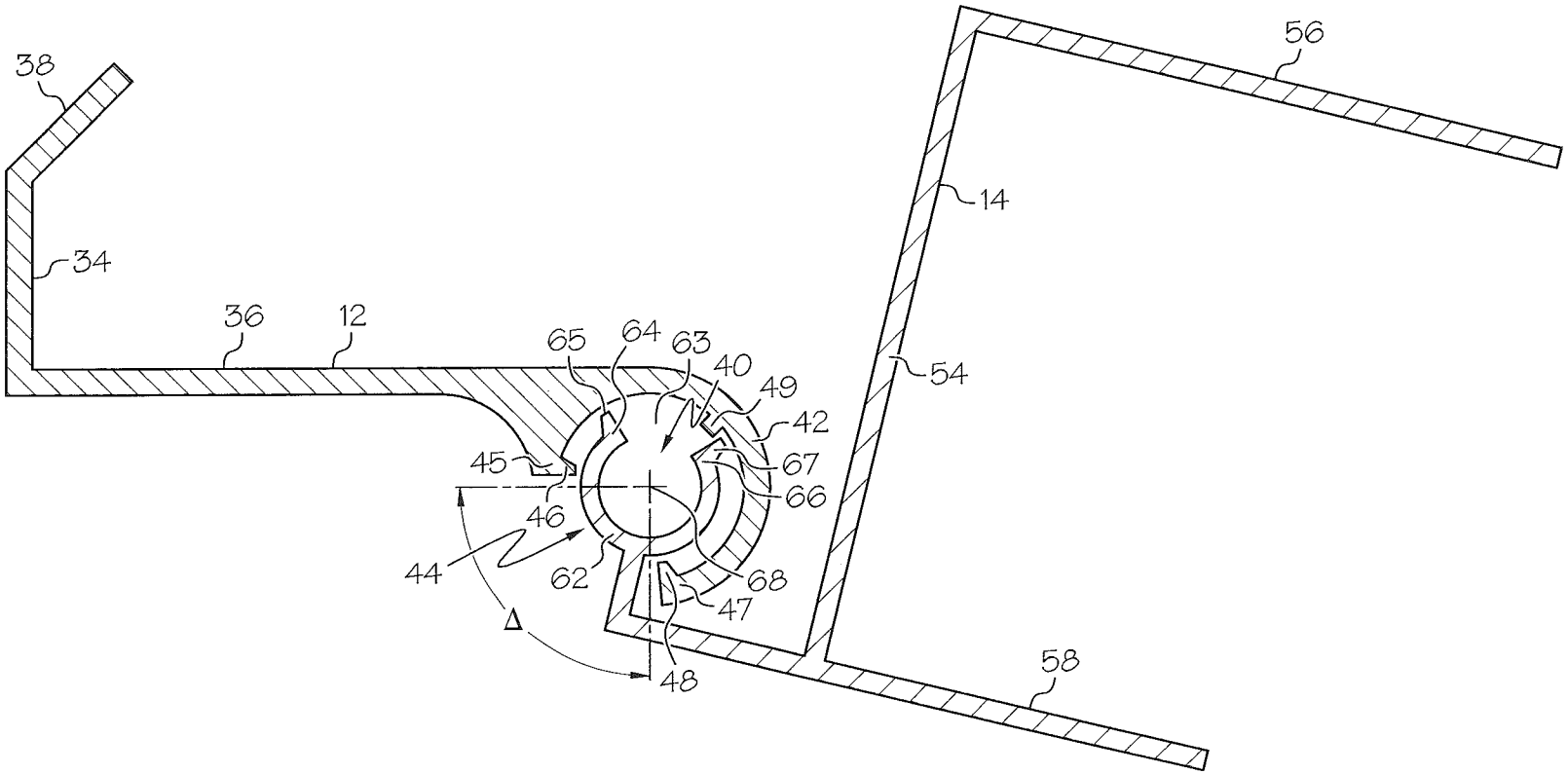
FIG. 4 is a side view of one embodiment of a hinge assembly comprising a header and the connection beam of FIG. 3 in accordance with the teachings of the present invention.

As further shown in FIG. 2, header 12 further comprises a connection socket 40 at the termination end of header leg 36. Connection socket 40 is defined by circular wall 42 which has an opening 44 therein defined by a first terminal end 45 and a second terminal end 47. As best seen in FIG. 4, to stiffen the terminal ends 45 and 47 of circular wall 42 which define opening 44, a first stiffener 46 and a second stiffener 48 may be disposed on each respective end 45 and 47. As appreciated by a person of skill in the art, stiffeners 46 and 48 may be orientated in any direction that effectively stiffen the open ends of circular wall 42 and prevents them from deforming under the applied forces. As shown in FIGS. 2 and 4, connection socket 40 may be orientated such that opening 44 is on the downward side of header 12 on the inward facing side of socket 40 when header is in an installed position. However, socket 40 may alternatively be configured so that said socket 40 is upwardly and/or outwardly facing.

Figure 3:
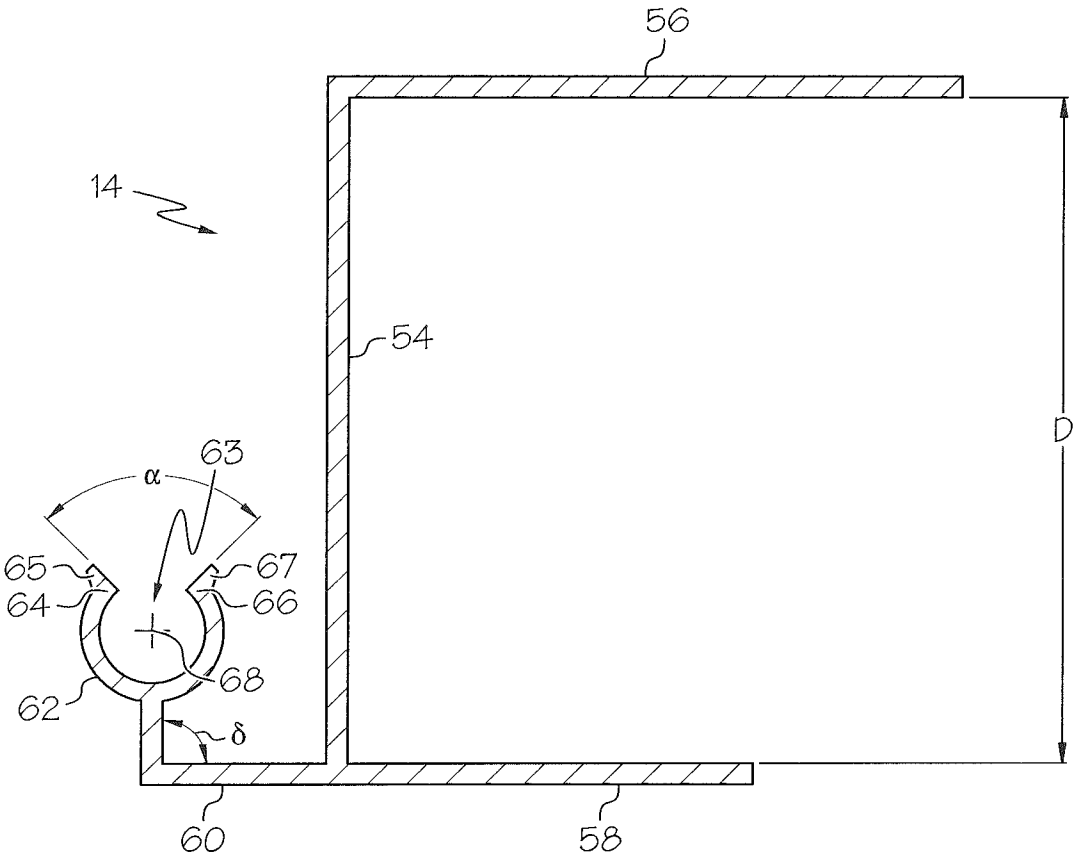
FIG. 3 is a side view of one embodiment of a connection beam of a folding carport in accordance with the teachings of the present invention.

Turning back to FIG. 1, connection beam 14 spans between a first end 50 and a second end 52 and is operably connected to header 12. FIG. 3 illustrates a cross-section of connection beam 14 having a web 54, a top flange 56, a bottom flange 58, a hinge arm 60 and a hinge member 62. Top flange 56 and bottom flange 58 define a clear distance "D" which generally corresponds to a thickness of roof deck 16. The embodiment of connection beam 14 shown in FIG. 3 further comprises hinge member 62 being substantially circular in shape and having an opening 63 defined therein. Opening 63 is defined by one end 64 of hinge member 62 having a first stiffener 65 and a second end 66 of hinge member 62 having a second stiffener 67. As shown in FIG. 2, hinge member 62 is configured to have a shape that is complementary with and matingly received within connection socket 40. Thus, connection beam 14 may be operably connected to header 12.

As shown in FIG. 3, ends 64 and 66 may define opening 63 defining an angle $\alpha$ having a vertex at the center 68 of hinge member. Angle $\alpha$ may be any angle in the range from about one degree to three-hundred fifty nine (1-359) degrees, with a preferable range between fifteen and one hundred thirty-five (15-135) degrees. The embodiment shown in FIG. 3 includes an angle α of around ninety (90) degrees. As also shown in FIG. 3, hinge member 62 may be orientated at an angle δ in relation to hinge arm 60. Angle δ may be any angle which allows operation of folding carport 10. However, angle δ will preferably be between fifteen and three-hundred forty-five (15-165) degrees. The embodiment shown in FIG. 3 includes and angle δ of around ninety (90) degrees.

FIG. 4 illustrates one embodiment of the hinging interaction between header 12 and connection beam 14. As shown, connection beam 14 includes hinge member 62 being received into socket 40 of header 12. As shown, connection beam 14 is configured to rotate about center point 68 within socket 40. Opening 63 of hinge member 62 is defined by first end 64 and second end 66 wherein each end 64 and 66 includes an outward facing stiffener 65 and 67 respectively. One embodiment of socket 40 includes a stop 49 as shown that engages an end 64 or 66 and associated stiffener 65 or 67. As shown, stop 49 may be positioned such that second end 66 and stiffener 67 engage stop 49 when stop is in a fully erected position. In this embodiment, first end 64 and stiffener 65 may be positioned so that they will engage stop 49 when the connection beam is hinged into a folded position.

As shown in FIG. 4, hinge member 62 bears on stiffener 46 and 48 of ends 45 and 47 of outer wall 42 defining socket 40. Socket 40 also has opening 44 being configured to allow connection beam 14 to have an angle of rotation of angle Δ. As shown, the angle Δ may be around ninety (90) degrees. However, angle Δ may be any angle that retains the ability for socket 40 to support and retain hinge member 62 therein, but preferably angle Δ will be between one and one-hundred eighty (1-180) degrees.

Turning back to FIG. 1, roof deck 16 spans from a top side 70 proximate connection beam 14 to a bottom side 72 proximate tilt beam 18. Roof deck 16 spans a width W of carport 10 as shown. Moreover, roof deck 16 further includes a first side 74 and second side 76 defining a length L with corrugations spaced along length L and spanning from connection beam 14 to tilt beam 18 as shown. As further shown in FIG. 1, the present carport 10 may also include bracing 26 under deck 16 to brace the assembly of the connection beam 14, roof deck 16 and tilt beam 18 to provide additional lateral stability and structural integrity. Now turning to FIG. 2, the connection of roof deck 16 to connection beam 14 is shown. Roof deck 16 further comprises a top surface 80 and a bottom surface 82 which defines a deck thickness "T." Deck thickness T of roof deck 16 may be slightly less than clear distance D between top flange 56 and bottom flange 58 of said connection beam 14 as shown. This allows roof deck 16 to be received into connection beam 14 and fastened thereto with fasteners 302. Fasteners 302 may be self-drilling sheet metal screws, other screws, rivets, mechanical or chemical weld, nails, bolts or any other fastener now known or hereafter developed. One embodiment includes a foam insert 24 being inserted in the pans of roof deck 16 proximate its connection to connection beam 14 as shown. Bracing 26 is also shown under bottom surface 82 and may be any structural shape and size required to provide adequate bracing resistance. One embodiment incorporates two-inch by two-inch (2"×2") structural tubing.

Roof deck 16 may be a single sheet, or may be comprised of a plurality of pans which overlappingly engage with the laterally adjacent pans as known in the art. One embodiment includes roof deck 16 comprising RHINO PANS™ as known in the art. Roof deck 16 may be any combination of deck thickness T and deck material gauge thickness necessary to provide the desired structural span between connection beam 14 and tilt beam 18. A person of skill in the art will appreciate that the determination of such characteristics may result in numerous combinations of deck thicknesses and gauge thicknesses, such that if the profile of the roof deck 16 is required to be thinner, the gauge thickness of the roof deck material may be increased depending upon the span, and vice-versa. Roof deck 16 may also be any roof pan size or gauge, the determination of which is well within the skill of a person in the art. Moreover, roof deck 16 may be any material now known or hereafter developed for such roofing applications, such as steel, fiberglass, aluminum, or carbon fiber.

Figure 5:
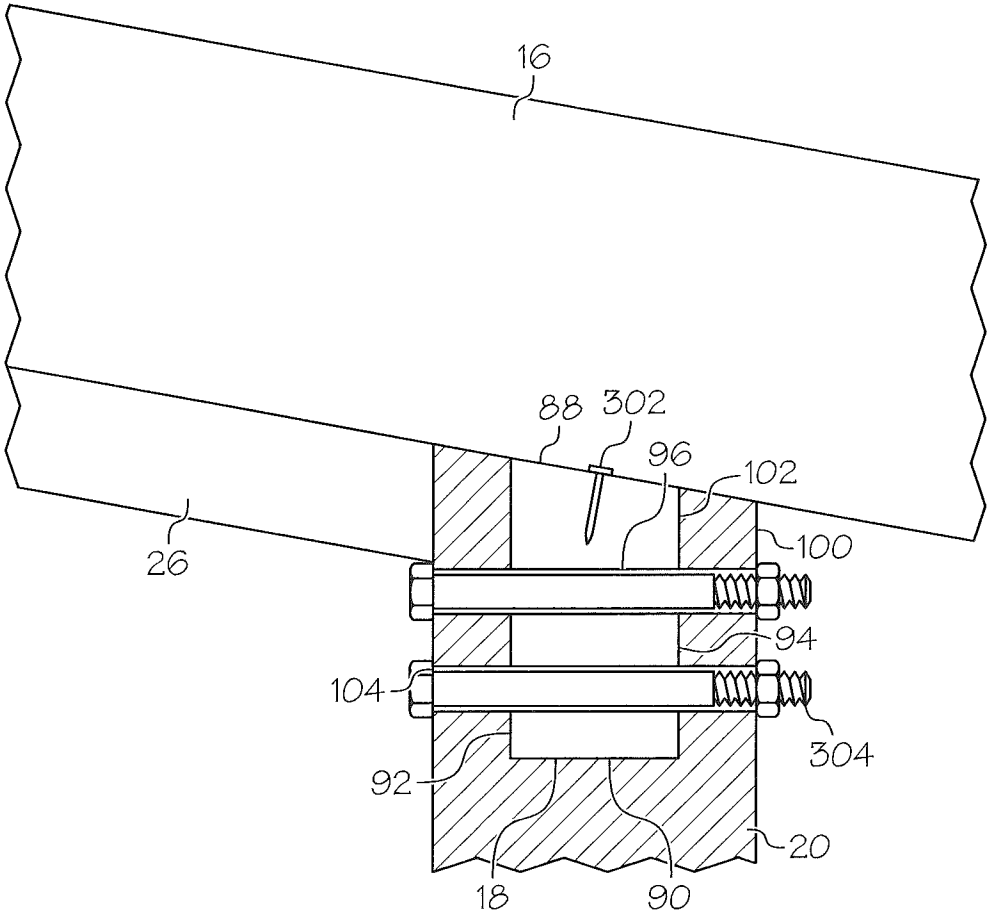
FIG. 5 is a sectional view of one embodiment of the folding carport of FIG. 1 cut along the line 5-5.
Figure 6:
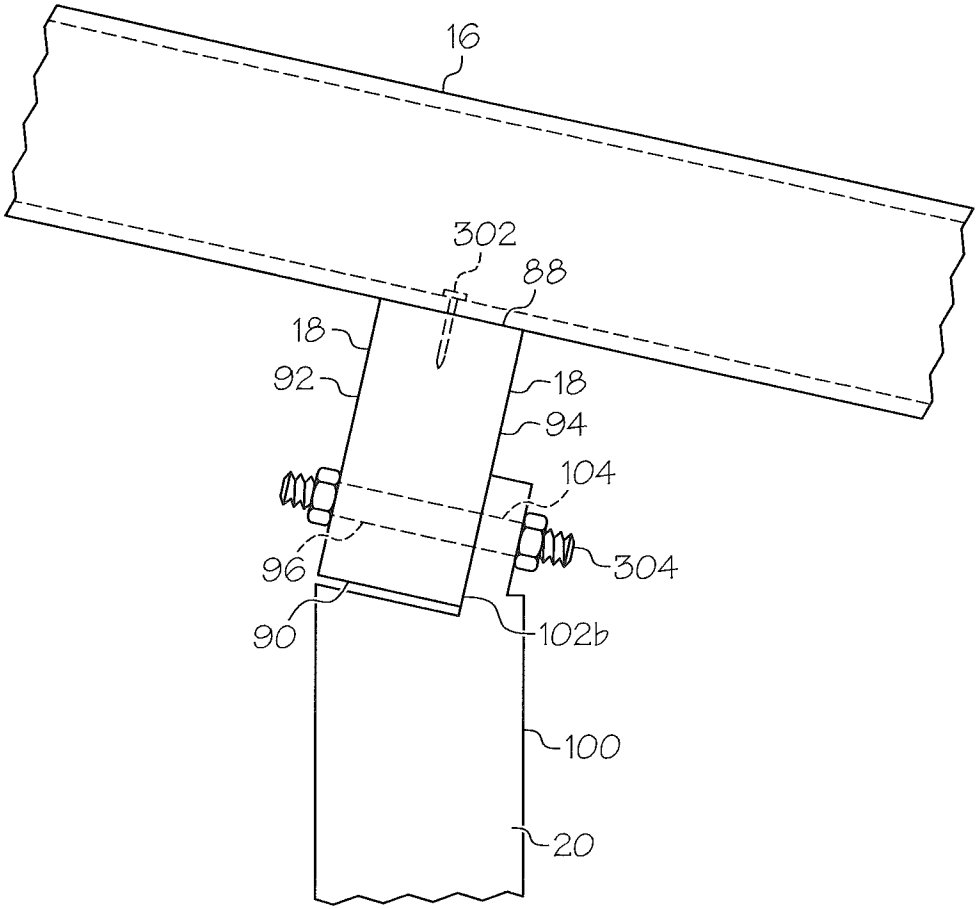
FIG. 6 is a sectional view of another embodiment of a tilt beam and post of a folding carport in accordance with the teachings of the present invention.

FIG. 1 also illustrates tilt beam 18 having a first end 84 and a second end 86. FIG. 5 illustrates an embodiment of the present carport wherein tilt beam 18 having a top 88, a bottom 90, an inside face 92 and an outside face 94. As shown in FIG. 5, tilt beam 18 may include a top 88 that is beveled to match the slope of the roof deck 16. The bevel allows the deck to bear directly on top 88 of tilt beam 18, but maintains both inside face 92 and outside face 94 in a vertical orientation making more efficient use of the geometry and structural characteristics of tilt beam 18. In another embodiment shown in FIG. 6, tilt beam 18 may be oriented such that top 88 and bottom 90 are square and substantially parallel to roof deck 16, wherein both inside face 92 and outside face 94 are perpendicular to roof deck 16. FIGS. 5 and 6 also show tilt beam 18 having connection apertures 96 therethrough extending from inside face 92 to outside face 94. FIGS. 5 and 6 also show that roof deck 16 is fastened to tilt beam 18 using a fastener 302 and that tilt beam 18 is generally coupled to and supported by post 20.

Tilt beam 18 may be made from conventional or manufactured wood products, steel, aluminum, polymer-wood composite lumber, or any other material know known or hereafter developed. Tilt beam 18 is preferably a material that is substantially resistant to corrosion. Tilt beam 18 may span the entire length L of carport 10 or may comprise sections of multiple spans between adjacent posts 20. The configuration of the beam span will necessarily affect the allowable span length of each tilt beam section for the codified required load resistance.

Now turning back to FIG. 1, posts 20 are shown in a substantially vertical orientation having a bottom end 98 and a top end 100 and functioning to transfer the gravity roof load from tilt beam 18 to existing concrete pad 208 as shown. Posts 20 are spaced at a span distance S and support carport 10 at a height H. Span distance S is may be determined by the allowable bending capacity of tilt beam 18. Post 20 may also act as a hold-down for tilt beam 18 in some embodiments if wind events result in an uplift force applied to roof deck 16. Post 20 may include a telescoping or adjustment feature (not shown) allowing a user to adjust the length of post 20. FIG. 5 illustrates the interaction of tilt beam 18 and post 20 in one embodiment of the present carport. As shown, post 20 includes a beam notch 102 formed therein at top end 100. Beam notch 102 is sized to receive tilt beam 18. Top end 100 of post 20 also includes one or more top apertures 104 that correspond to the location of apertures 96 of tilt beam 18 so that fasteners 304 may be inserted therethrough. Fasteners 304 are preferably bolts or other fastener that encourages a structurally stable, yet reversible connection so that the post and beam connection can be separated at the discretion of the owner. As known in the art, the load transfer from the beam 18 to the posts will be accomplished through bearing wherein beam notch 102 may be configured so that bottom 90 of tilt beam 18 bears on post 20, or the fasteners 304 may transfer the load from tilt beam 18 to post 20. In addition, the load transfer may comprise a combination of both bearing and bolt transfer, or may be a fully redundant system that incorporates both options fully designed. FIG. 6 illustrates another embodiment similarly configured where post 20 includes a beam notch 102*b* at top end 100. However, because of the orientation of tilt beam 18, notch 102*b* is irregular shaped. Apertures 104 through post 20 may be orientated perpendicular to inside and outside face 90 and 92 of tilt beam 18 as shown in FIG. 6 rather than horizontal as shown in FIG. 5.

Figure 7:
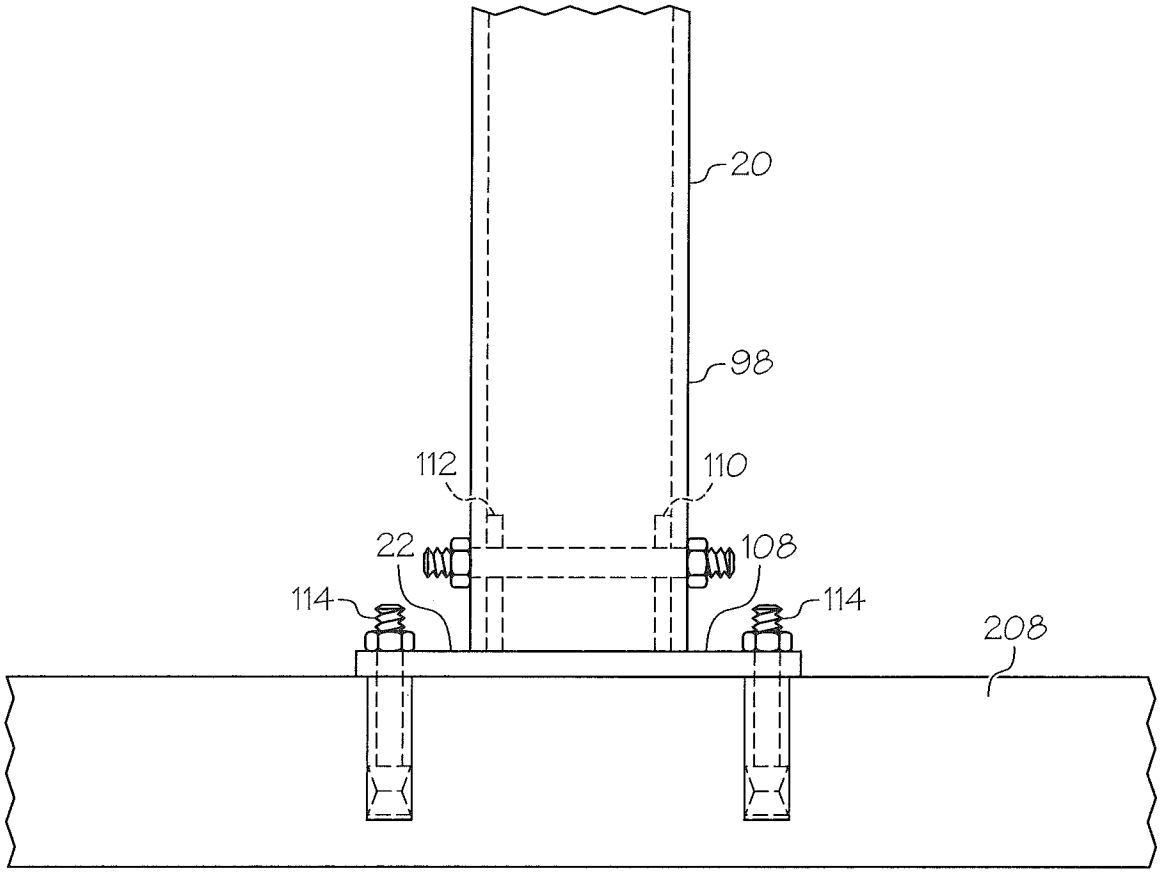
FIG. 7 is a sectional view of one embodiment of the folding carport of FIG. 1 cut along the line 7-7.

FIG. 7 illustrates one embodiment of the connection of the bottom end 98 of post 20 to an existing concrete slab 208 or an isolated concrete footing. Base plate 22 comprises a bearing plate 108, a first connection arm 110 and a second connection arm 112 and may be fastened to concrete slab 208 using one or more fasteners 114. The embodiment shown in FIG. 7 shows a bearing plate 108 of base plate 22 being coupled to a previously existing concrete slab wherein concrete anchors 114 are used. Concrete anchors 114 may be an epoxy anchor, grout anchor, expansion, or wedge anchor 114 as commonly known in the art. Moreover, if concrete slab 208 is being poured specifically for use with the present folding carport 10, cast-in anchors may also be used. Another alternative is to use embedded threaded sleeves that are installed flush with the concrete slab, wherein base plate 22 may be removably attached to the slab 208 with bolts received into the embedded threaded sleeves which leaves the pad with a flush surface when the carport is in a folded position. Anchors 114 are preferably stainless steel to reduce the potential for corrosion thereof. As known in the art, a grout layer (not shown) may be implemented between the bearing plate 108 and concrete slab 208. It is also within the scope of the present invention for the posts 20 to be supported directly to the ground, which may include a buried tie-down. An embodiment wherein the base plate 22 bears directly on the ground without a tie-down, however, does not provide much uplift resistance.

As shown in FIG. 7, base plate 22 may include a first connection arm 110 and a second connection arm 112, both connection arms 110 and 112 coupled to and extending away from and substantially perpendicular to bearing plate 108. Connection arms 110 and 112 are shown being configured to fit inside post 20 wherein post 20 is a rectangular tube section. Alternatively, connection arms 110 and 112 may be configured to be positioned on the outside of post 20, this configuration is particularly applicable if the post is a solid member. In another embodiment, for example, if post 20 is a circular tube section, connection arms 110 and 112 may be replaced by a sleeve (not shown) having a substantially similar shape as the post, but configured to be received inside the tube section of the post. Alternatively, post 20 may be configured to be received into the sleeve. Such sleeve connections are commonly known in the art.

As shown, connection arms 110 and 112 of base 22 extend away from bearing plate 108 and are received into post 20. Post 20 may be secured to connection arms 110 and 112 and base plate 22 using fastener 304. Again, fastener 304 is preferably a bolt or other temporary fastening mechanism so that the present carport may be easily disassembled. However, any fastener now known or hear after developed in the art may be used.

Figure 8:
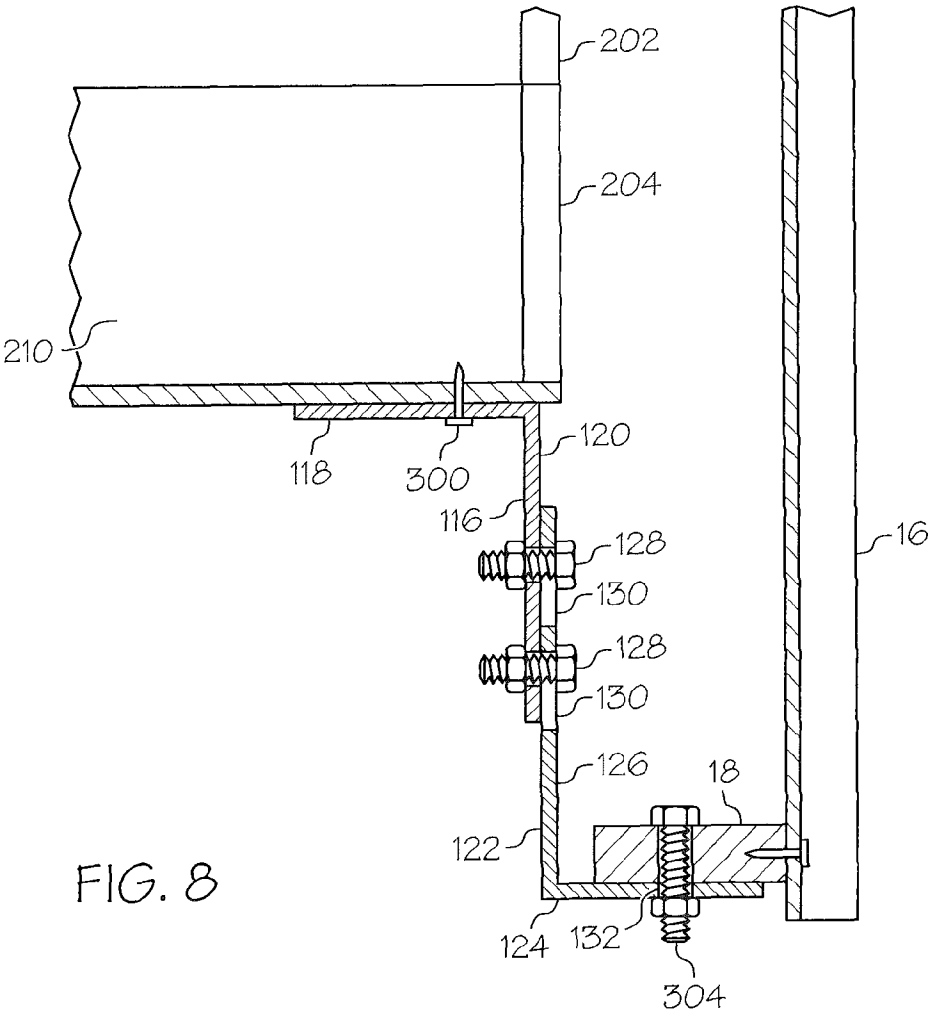
FIG. 8 is a side view of one embodiment of a carrier plate of a folding carport in accordance with the teachings of the present invention.

Another feature of the present carport 10 is that it can be installed on the mobile residence 200 at one location, moved to the designated erection site with installation completed on-site. Thus, the carport can be permanently attached to the mobile residence 200, folded down, secured to the mobile residence 200 at a distinct installation facility and remain attached to the mobile residence 200 during transport. To facilitate transportation of the mobile residence 200 to the building site when the mobile residence 200 is being transported or when the carport 10 is being stored in a folded position, carrier plate 28 may be used to secure the carport 10 in the folded position as illustrated in FIG. 8. As further shown in FIG. 8, carrier plate 28 comprises a first angle 116 with a first leg 118 and a second leg 120 and a second angle 122 having a first leg 124 and a second leg 126. As illustrated, one embodiment includes second legs 120 and 126 of each angle 116 and 122 being longer than first legs 118 and 124.

FIG. 8 illustrates first angle 116 and second angle 122 being positioned to form a "Z" shaped carrier plate 28. Second legs 120 and 126 may be vertically orientated and slidably coupled thereby allowing for an adjustment in the distance between generally horizontally extending first legs 118 and 124 which are on opposite ends of carrier plate 28 as shown. The adjustment of the distance between first legs 118 and 124 may be facilitated by a slotted bolt hole 130 in either second leg 120 or 126 and a regular or slotted bolt hole in the other. Thus, a slot bolt 128 is inserted through the hole and slot 130. When bolt 128 is loosened, the second legs 120 and 126 are slidable relative to each other, and when bolt 128 is tightened, the two second legs 120 and 126 are fixed in a relative position. A person of skill in the art will recognize that the adjustment of the relative position of angles 116 and 122 may be achieved by any number of methods now known.

FIG. 8 further illustrates first leg 118 of first angle 116 being coupled to an outside bottom stringer 210 of mobile residence 200 with a fastener 300 as shown. As stated above, fastener 300 may be a lag-bolt, bolt, screw, nail, glue, mechanical or chemical weld, or any other fastener now known or hereafter developed. First leg 124 of second angle 122 extends away from exterior wall 202 of mobile residence 200 as shown. First leg 124 of second angle 122 generally has a bolt hole 132 which is configured for tilt beam 18 to be secured to first leg 124 of second angle 122 during transport or storage by one or more fasteners 304 as shown. Carrier plate 28 may be positioned on mobile residence 200 to match the spacing S of posts 20 so that the apertures 96 in tilt beam 18 may align with one or more bolt holes 132 in the first leg 124 of second angle 122. Further, once the present carport is erected and while it remains erected, carrier plate 28 may be entirely removable, or alternatively, a user may remove second angle 122 or simply reverse the orientation of first leg 124 of second angle 122 so that it points inward, under the mobile residence 200 to avoid a user bumping into or tripping on first leg 124.

One embodiment of the present carport 10 may include a lift assistance element (not shown), such as a pneumatic or mechanical lift as now known or hereafter developed to help an owner erect or take down the roof assembly. The lift assistance element will likely be coupled to exterior wall 202 of mobile residence 200 and to roof deck 16, tilt beam 18 or another support member disposed on the roofing assembly for this purpose.

Foldable carport 10 and all components thereof may be made from steel, aluminum, iron, brass, titanium, wood, fiberglass, carbon composite, polymers, plastics, or any other material now known or hereafter developed.

In use, the present carport may be installed on-site or, preferably, the header and a roofing assembly comprised of the connection beam 14, roof deck 16, tilt beam 18, and optionally the bracing 26 at an off-site location wherein the mobile residence 200 is transported to the residential site with carport 10 attached thereto. Then, post bases 22 and other concrete work may be done on-site before and/or after mobile residence 200 is on-site. As shown in FIGS. 1 and 2, header 12 is coupled to the exterior wall 202 of mobile residence 200. Connection beam 14, roof deck 16 and tilt beam 18 and, optionally, bracing 26 may then be assembled and fastened together as a roof assembly. Alternatively, connection beam 14 may be operably connected to header 12 prior to fastening the roof deck 16 and, optionally, bracing 26 thereto and the tilt beam 18 to roof deck 16. In any event, as shown in FIG. 2, hinge member 62 is complementary in shape and is received into socket 40 thereby operably connecting beam 14 to header 12 such that connection beam 14 freely hinges within socket 40 of header 12 from at least an installed position shown in FIG. 1 to a folded position shown in FIG. 7. As shown in FIG. 2, the operable connection between connection beam 14 and header 12 is facilitated by the shape of socket 40 of header 12 and the mating hinge member 62 of beam 14. As shown in FIG. 4, the degree of rotation A of beam 14 within header 12 may be determined by the dimension and the position of opening 44 in circular wall 42 of socket 40.

As mentioned above, once the assembly of the connection beam 14, roof deck 16, tilt beam 18 and, optionally, bracing 26 is completed and operably connected to header 12, the present carport 10 may be then folded and secured to mobile residence 200 for transport using carrier plate 28. This feature allows the present carport 10 to be partially installed by technicians who are skilled in working with the features and unique construction of mobile residences, yet allows the on-site installation to be performed by persons skilled in conventional construction. This provides an improved overall product which is not available in the current marketplace. Alternatively, the entire carport may be constructed and installed on-site if desired using header 12 and connection beam 14.

Once header 12, connection beam 14, roof deck 16, tilt beam 18 and, optionally, bracing 26 are assembled and the mobile residence is on site, posts 20 may then be installed. Posts 20 are fastened to tilt beam 18 as shown in FIGS. 5 and 6. As described above, post base 22 may be installed in an existing concrete slab 208 or an individual isolated footing poured to support the present carport 10. One installation method comprises bolting post base 22 to post 20 prior to fastening post base 22 to concrete slab 208. The exact desired position of post 20 can then be set and the position of the anchors 114 may be exactly determined. The holes for the anchors 114 can then be drilled in the concrete slab 208 and the post base 22 is coupled to concrete slab 208. Alternatively, post base 22 may be installed based upon the spacing and location of the present carport 10 on a provided plan prior to the present carport being on site. A person of skill in the art will appreciate that there are many methods used to locate and install post base 22, all of which are intended to be within the scope of the present invention. Then, post 20 may be coupled to post base 22 to complete the installation.

Once carport 10 is installed and erected, it can remain so indefinitely. There are many circumstances in which persons use such carports and reasons why a user would want to fold down carport 10. To fold down carport 10, fasteners 304 are removed and posts 20 are disconnected from post bases 22 and from tilt beam 18. Connection beam 14 hinges within socket 40 of header 12 allowing carport 10 to fold downward. As shown in FIG. 8, tilt beam 18 can then be fastened to carrier plate 28 to secure carport 10 in a folded position for storage or transport. In cases where the mobile residence is a seasonal residence, a user may wish to fold down carport 10 when the user is closing up the mobile or conventional residence to return to their other seasonal home. In such cases, a locking mechanism may be substituted for fastener 304 in FIG. 8 or additional integrated into the carport 10 to secure an entrance to the mobile or conventional residence. Since may people have residences in warm, coastal areas, a user may fold down the folding carport 10 during an impending extreme weather event such as a hurricane, typhoon, snow storm, hail storm, or other extreme weather event. In such cases, the folded carport may be protected from damage during an extreme weather event and may additionally serve as a protective barrier for mobile residence 200 during extreme weather events.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

I claim:

1. A foldable carport:

a header having a hinge socket, said header configured to be fastened to an inhabitable structure;

a roof assembly comprising a connection beam, a tilt beam, and a roof deck spanning between and fastened to said connection beam and said tilt beam, wherein said connection beam includes a hinge member received into said hinge socket thereby operably connecting said roof assembly to said header;

an erected position; and a folded position, wherein said folded position comprises said tilt beam removably coupled to a carrier plate, said carrier plate being coupled to the inhabitable structure, said carrier plate having an adjustable length.

2. The foldable carport of claim 1 wherein said erected position includes a plurality of posts, each of said plurality of posts having a top end and a bottom end, said bottom end bearing upon a post base and said top end of said post supporting said tilt beam.

3. The foldable carport of claim 1 wherein said hinge socket is defined by a circular wall having an opening defined in said circular wall by a first terminal end and a second terminal end.

4. The foldable carport of claim 3 wherein said opening is positioned on a downward facing side of said header and on an inward facing side of said hinge socket.

5. The foldable carport of claim 3 wherein said opening of said hinge socket is of a arc distance defined by an angle, said angle being approximately ninety (90) degrees.

6. A foldable carport comprising:

a header having a hinge socket, said header configured to be fastened to a mobile residence;

a connection beam having a hinge member received into said hinge socket thereby operably connecting said connection beam to said header;

a post having a top end and a bottom end, said bottom end bearing upon a post base;

a tilt beam supported at said top end of said post;

a roof deck having a top side and a bottom side, said roof deck fastened to said connection member proximate said top side and fastened to said support beam; and a carrier plate coupled to the mobile residence, said carrier plate having an adjustable length and configured to be coupled to said tilt beam when said foldable carport is in a folded position.

7. A hinging support assembly for a foldable carport comprising:

a header having a header leg and a connection leg wherein said connection leg terminates at a connection socket, said connection socket being defined by a substantially circular wall, wherein said connection socket includes an opening defined by a first end and a second end of said wall, wherein said opening of said connection socket is an arc distance, said arc distance defined by a first angle, said first angle being approximately ninety (90) degrees, and further wherein said opening of said hinge member is an arc distance, said arc distance being defined by a second angle, said second angle being approximately ninety (90) degrees, and further wherein said connection socket includes a stop that engages one of said first and said second ends of said hinge member to limit the rotation of said hinge member within said connection socket;

a connection beam having a top flange, a bottom flange, and a web disposed between said top flange and said bottom flange, a hinge arm extending away from said web in a direction opposite said flanges, a hinge member having an opening defined by a first end and a second end; and wherein said hinge member is received into said socket thereby operably connecting said header and said connection beam.

8. The hinging support assembly of claim 7 wherein said opening is positioned on a downward facing side of said header and on an inward facing side of said hinge socket.

* * * * *